United States Patent [19]

Johnson

[11] Patent Number: 4,576,042

[45] Date of Patent: Mar. 18, 1986

[54] FLOW BASKET

[75] Inventor: Irvin D. Johnson, Englewood, Colo.

[73] Assignee: Marathon Oil Company, Findlay, Ohio

[21] Appl. No.: 686,514

[22] Filed: Dec. 26, 1984

[51] Int. Cl.[4] ..... E21B 47/00

[52] U.S. Cl. ..... 73/155

[58] Field of Search ..... 73/155; 166/192, 202

[56] References Cited

U.S. PATENT DOCUMENTS

| | | | |
|---|---|---|---|
| 1,979,802 | 11/1934 | Kinley | 166/202 |
| 2,649,710 | 8/1953 | Dale | 73/155 |
| 2,649,711 | 8/1953 | Dale | 73/155 |
| 2,706,406 | 4/1955 | Vincent et al. | 73/155 |
| 2,932,740 | 4/1960 | Widmyer | 73/155 |
| 3,119,451 | 1/1964 | Hall | 166/202 |
| 3,163,038 | 12/1964 | Bryant | 73/155 |
| 3,195,042 | 7/1965 | Glenn, Jr. et al. | 73/155 |
| 3,385,368 | 5/1968 | Solum et al. | 166/202 |
| 3,955,625 | 5/1976 | Hughes et al. | 166/202 |

OTHER PUBLICATIONS

O.I. Corporation brochure.

*Primary Examiner*—Stewart J. Levy
*Assistant Examiner*—Robert R. Raevis
*Attorney, Agent, or Firm*—Jack L. Hummel; Rodney F. Brown

[57] ABSTRACT

A flow basket for use in an apparatus for measuring flow rates having a plurality of substantially triangular shaped petals that selectively open and close about a shaft. A plurality of support bows extend over the petals and attach to the opening end of each petal wherein the support bows are further interconnected to the shaft so that the support bows open and close the petals only in an outward radial direction.

16 Claims, 11 Drawing Figures

FLOW BASKET

BACKGROUND OF THE INVENTION

1. Related Invention

This application is related to the invention disclosed in an application entitled "Self-contained Bore Hole Flow Measurement System and Method Therefor", Ser. No. 686,513 by the present inventor and filed concurrently on the same date as this application.

2. Technical Field

This invention relates to baskets for determining flow rates in oil wells and, more particularly, to an improved flow basket having formed petals that move only in one direction.

3. Background Art

As set forth in the above identified co-pending application, one important parameter of oil well production is the determination and measurement of the flow in the well at various production levels in the bore hole. Therefore, this invention relates to a type of flow basket adapted for use in the measurement of fluid velocities in wells.

Prior to the present application, the inventor effectuated a patentability search on flow baskets which uncovered the following patents:

| Inventor | Reg. No. | Issue Date |
|---|---|---|
| M. M. Kinley | 1,979,802 | Nov. 6, 1934 |
| C. R. Dale | 2,649,710 | Aug. 25, 1953 |
| C. R. Dale | 2,649,711 | Aug. 25, 1953 |
| R. P. Vincent | 2,706,406 | Apr. 19, 1955 |
| J. A. Hall | 3,119,451 | Jan. 28, 1965 |
| H. L. Bryant | 3,163,038 | Dec. 29, 1964 |
| J. J. Glenn, Jr. | 3,195,042 | July 13, 1965 |
| R. H. Widmyer | 2,932,740 | Apr. 12, 1960 |
| J. R. Solum | 3,385,368 | May 28, 1968 |
| Hughes et al. | 3,955,625 | May 11, 1976 |

The patent issued to Hall discloses a cement basket having a plurality of petals which are allowed to move freely within outward metal bow strings around the basket. The bow strings are attached to collars which slide along the shaft and engage fixed stops. The metal basket selectively opens and closes and is able to rotate about the shaft. In one embodiment, one of the bow string collars is affixed to the shaft. The patents to Solum et al. and Hughes et al. also disclose other types of cementing baskets.

The patents to Dale, Vincent and Bryant relate to flowmeters. The two Dale patents show a trap composed of opening and closing extended metallic fingers attached to circularly overlapping metallic vanes. The Vincent patent directs the flow by means of a packer into an impeller sensor. The packer Vincent, which is made of flexible material, is disposed under a plurality of bow strings and moves from a collapsed state to an open state. The Bryant fluid diverter also utilizes a basket under the bow strings. Both ends of the Bryant basket are affixed to the bow strings. In Bryant, the ends of the bow string attached to the end of the basket are also affixed to the shaft whereas the opposite ends of the bow strings are attached to a ring that travels along the shaft with the opening and closing of the basket. The remaining patents uncovered in the search are not close to the present invention as those discussed above.

Another prior art reference is the commercially available powered flow diverter, Model 5500, manufactured by OI Corporation, Graham Road at Welborn Road, P.O. Box 2980, College Station, Tex. In this approach, one end of the basket is allowed to slide along the shafts whereas the bow strings are affixed the entire longitudinal length of each petal to a fixed connection at the bottom end of the petal.

The OI Corporation product and the Bryant patent are believed to be pertinent to the teachings of the present invention. However, in both devices, movement of the petal in two or more directions can occur thereby causing buckling or distortion of the petal under normal operating conditions. Such buckling is undesirable as it may cause leaks or breakdown of the basket. In other words, in these two approaches, not only does outward radial movement of the basket occur but also circular or other movement which thereupon causes the buckling of the metal vanes. The present invention has for its goal the elimination of this problem as set forth next.

DISCLOSURE OF INVENTION

The problem to be solved, therefore, is to provide a flow basket comprised of metal vane petals and a plurality of outwardly disposed bow strings which provide movement in only one direction (i.e., an outward radial direction) without providing circular or other movement so as to eliminate buckling of the petals. The present invention provides a solution to this problem with a flow basket that opens and closes the metallic vane petals in only one direction—i.e., the outwardly radial direction.

The present invention accomplishes this by providing, in a first embodiment, a plurality of thin metal petals arranged to form a collapsible basket connected at one end to a first attachment point. It further includes a comparable plurality of outer bow strings having one end connected at the opening edge of the metal petals and the opposing end attached to a second attachment point such as a collar around the shaft. In this embodiment, one of the two attachment points can be affixed to the shaft with the other attachment point being slideable along the shaft.

In a second embodiment of the present invention, like the structures of Bryant and OI Corporation, the metal bow strings extend up and over the opening end of the collapsible basket to a third point of attachment. In this embodiment, to provide a single direction of outward radial movement, two of the three attachment points must be capable of sliding along the shaft with the third point affixed to the shaft.

BRIEF DESCRIPTION OF DRAWING

The details of the present invention are described in the accompanying drawing.

BEST MODE FOR CARRYING OUT THE INVENTION

Figure 1:
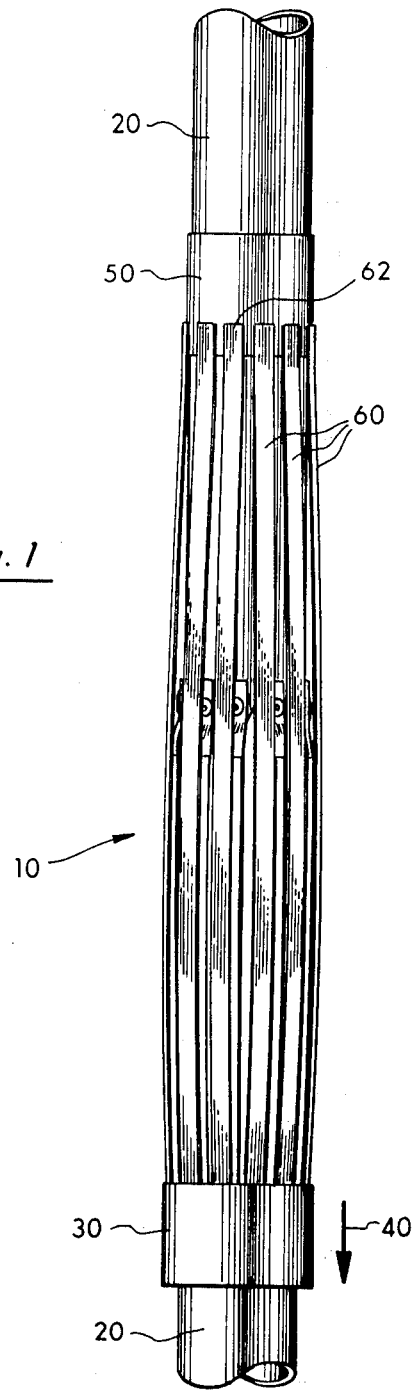
FIG. 1 is a side perspective view showing the basket of the present invention in a collapsed form about a shaft.

In FIG. 1, the basket 10 of the present invention is shown in a collapsed form about a shaft 20. The basket 10 is held in the collapsed state by a releasing collar 30. When the collar 30 moves downwardly in the direction of arrow 40, the basket 10 of the present invention opens as shown in FIGS. 2 and 3.

Figure 2:
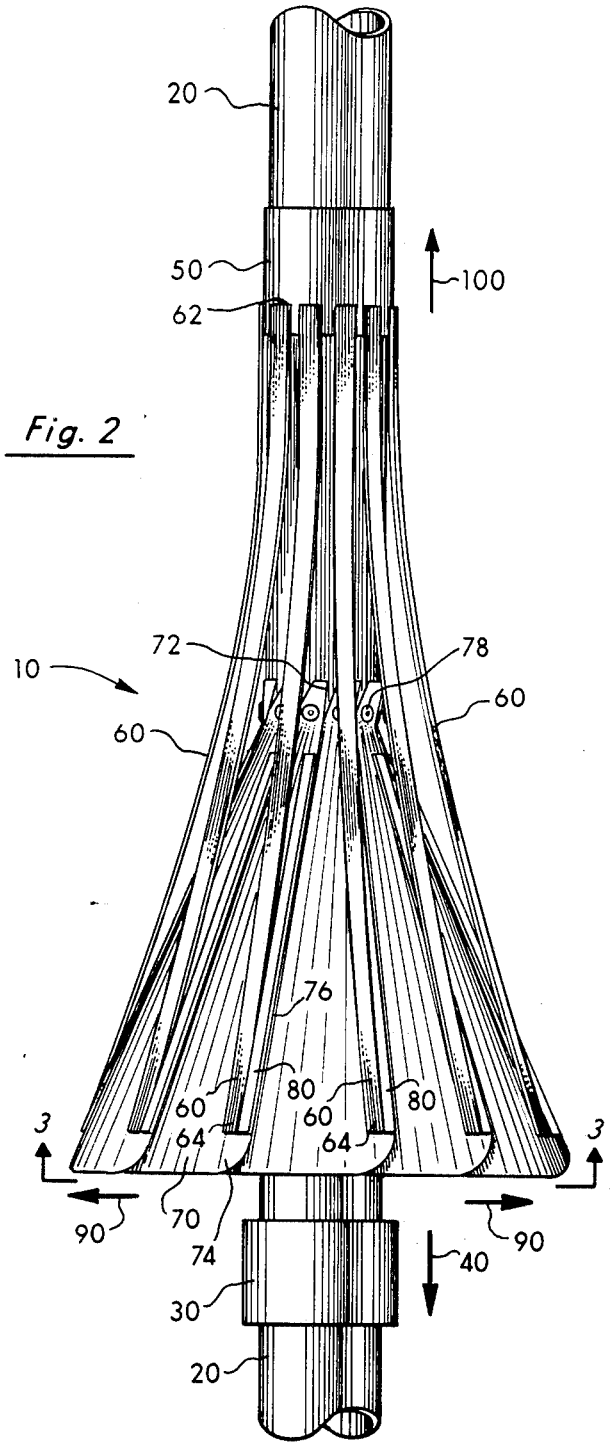
FIG. 2 is a basket shown in FIG. 1 in an expanded orientation.
Figure 3:
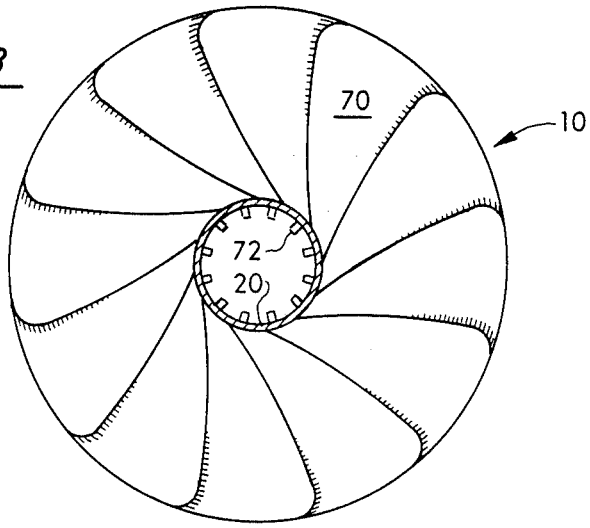
FIG. 3 is a bottom planar view of expanded basket of FIG. 2.

The basket 10 of the present invention as shown in FIGS. 1 and 2 utilizes a slideable collar 50 to which is attached a plurality of support bows or ribs 60. Each support bow is rectangular in configuration and has one end 62 affixed to collar 50 such as by soldering and a second end 64 affixed to a petal 70 also by soldering. The support bows can be constructed of any suitable configuration such as, for example, a circular rod. There are no other points of connection along the longitudinal length of the support bow 60 other than at the two ends 62 and 64.

Each petal 70 is firmly attached by means of a rivet 78 at the narrow terminal end 72 to shaft 20 and is connected at its other enlarged petal end 74 to end 64 of support bow 60. In the preferred embodiment, a number of petals 70 such as between eight and sixteen are provided with each petal 70 being connected to a corresponding support bow 60. Formed on the edge 76 of each petal 70 is a support ridge 80 which provides structural support to side 76. The support ridge is made from elongated rectangular shaped bar stock and provides rigidity to edge 76. Ridge 80 is soldered to petal 70 and extends from a region near end 72 to a region near end 74 of each petal 70. End 64 of bow 60 is soldered along side of ridge 80 and may be actually soldered to ridge 80 in this region.

As can be observed in FIG. 2, as the collar 40 is moved downwardly, petals 70 rapidly move outwardly in the direction of arrows 90 to open up. The opening of the petals 70 is caused by the spring tension in the support bows 60. At the same time, collar 50 moves upwardly along shaft 20 in the direction of arrow 100.

Figure 4A:
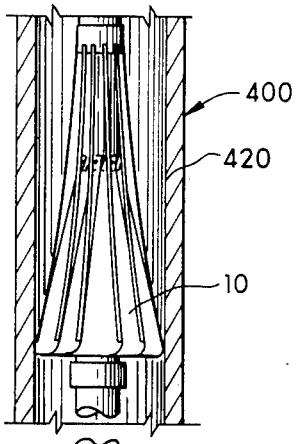
FIG. 4*a* is a side cross-sectional illustration showing the basket of the present invention in a first expanded configuration.
Figure 4B:
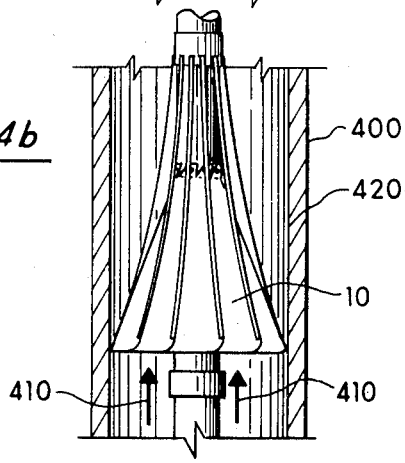
FIG. 4*b* is a side cross-sectional illustration of the basket of FIG. 4*a* in a seconded expanded condition.

As shown in FIGS. 4*a* and 4*b*, when utilized in a bore hole 400, the basket 10 of the present invention is capable of expanding or adjusting to the specific diameter of the bore hole 400 because of the spring tension in the support bows 60 and the flow pressure of the fluid upon the basket. The bore holes of FIGS. 4*a* and 4*b* show, for illustration purposes, two different sized diameters. Indeed, when the basket 10 of the present invention is pulled from the bore hole 400, the basket collapses to allow easy removal. As is evident in FIG. 4, fluid as represented by arrows 410 biases the petals 70 of the basket 10 to abut the support bows against the sides 420 of the bore hole regardless of the actual shape of the bore hole. Hence, even though the bore hole 400 is not absolutely circular, the pressure of the fluid 410 will cause the individual support bows to abut against the sides of the bore hole.

Figure 5:
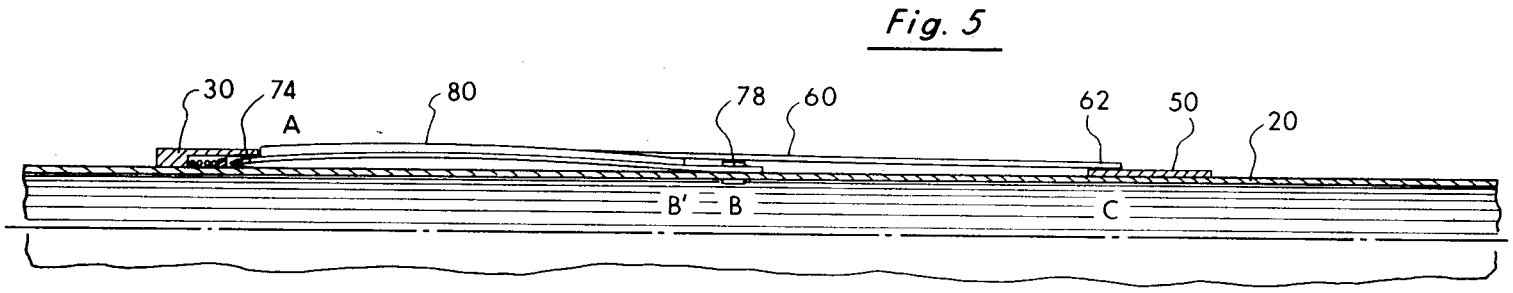
FIG. 5 is a partial side cross-sectional view of the basket of FIG. 1 in the collapsed form.
Figure 6:
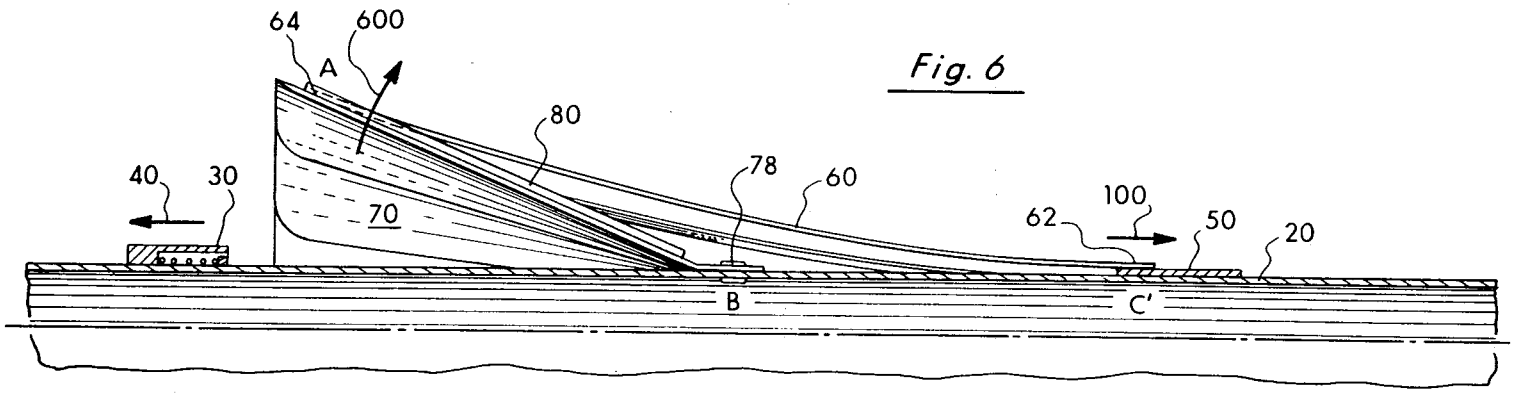
FIG. 6 is a side cross-sectional view of the basket of FIG. 5 in the expanded form.

The operation of the basket 10 of the present invention is set forth in FIGS. 5 and 6 which are side view representations corresponding to FIGS. 1 and 2. In FIG. 5, the basket 10 is in the closed position and with the movement of collar 30, the petals 70 are released and immediately move radially outwardly in the direction of arrow 600. Simultaneously, the lower collar 50 moves in direction of arrow 100. As shown in FIGS. 5 and 6, the basket of the present invention is provided with a fixed connection at point A (bows 60 to petals 70), a fixed connection at point B (petals 70 to shaft 20), and a sliding connection at point C (bows 60 with shaft 20). As shown in FIGS. 5 and 6, the collar 50 moves from position C to position C'. Clearly, the collar 50 could be riveted to the shaft 20 so that point C is affixed also. In that event, the end 72 of the petal 70 must be connected to a slideable collar rather than riveted so that point B is capable of moving along shaft 20. In that event, as shown in FIG. 5, the new position of such a sliding collar would be at B'. In essence, one point is fixed in order to provide relative movement to the other point so that each petal is lifted radially outwardly.

Either type of configuration can be utilized under the teachings of the present invention and still result in the outward opening of the petals 70 in one direction only. While point A must be always affixed, either points B or C can be affixed with the other point being slideable along shaft 20. It is clear from inspection of FIGS. 1, 2, 5, and 6 that each individual petal moves in only one direction (i.e., in arrow 600) which eliminates buckling caused by movement of conventional petals in two or more directions. Furthermore, the addition of ridge 80 enables the lifting of each petal 70 to occur without actual bending of the petals.

Figure 7:
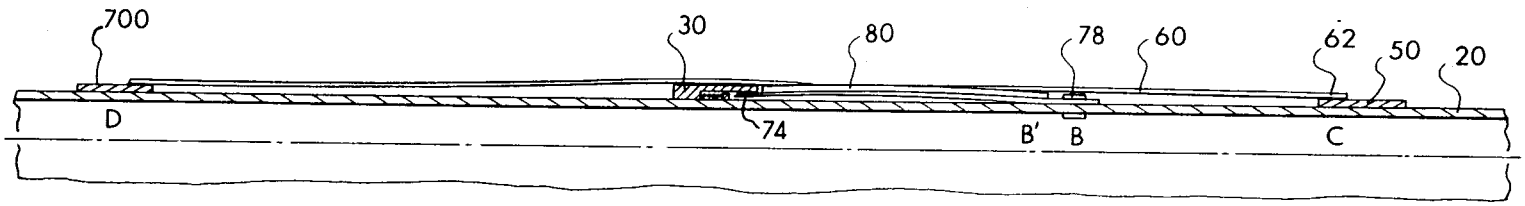
FIG. 7 is a side cross-sectional view of a second embodiment of the basket of the present invention in a collapsed form.
Figure 9:
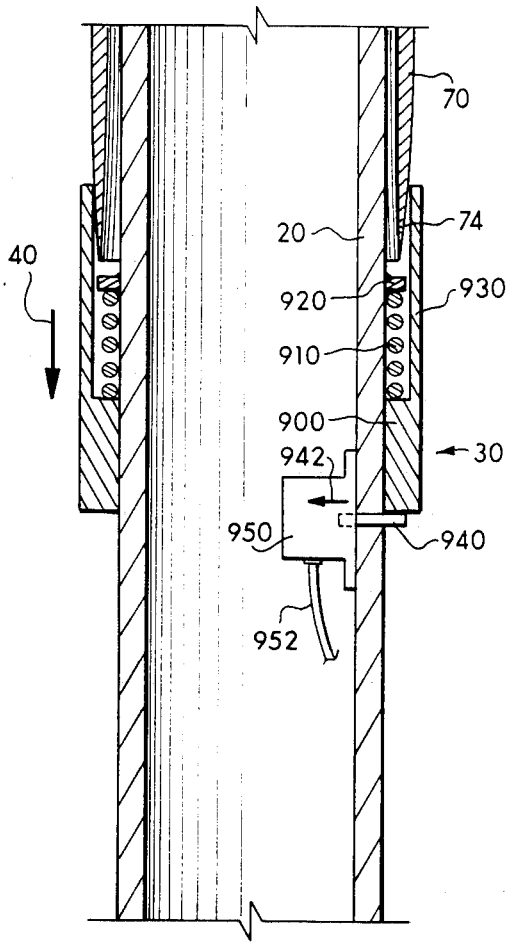
FIG. 9 is a cross-sectional view of the releasable collar of the present invention.

FIGS. 7 and 9 show a second embodiment of the present invention in which the support bows 60 extend over the petals 70 to another collar 700. Where possible, like numerical designations are used which correspond to the first embodiment. The bow 60 is affixed to the collar 700 in the same fashion that it is attached to collar 50. Hence, in FIG. 7, there is not much different in the collapsed state of this embodiment to the embodiment shown in FIG. 5. Each support bow 60 is elongated to approximately twice its length shown in FIG. 5 and an additional collar 700 is added to which end 602 of support bow 60 is attached. The bow 60 is now centrally attached to the petal end 74 at point A. Upon release of petals 70 the spring tension causes both collars 700 and 50 to move along shaft 20. Collar 700 moves in direction 710 to D' and collar 50 moves in direction of arrow 100 to C'. The petals 70 open in the fashion described for FIG. 5.

Figure 8:
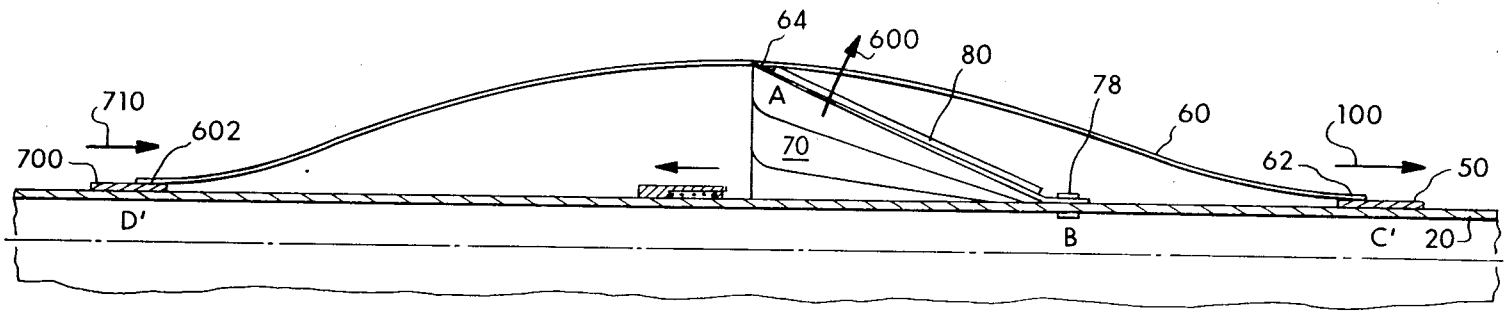
FIG. 8 is a side cross-sectional view of the basket of FIG. 7 in the expanded form.

In this embodiment, variations can also be made. Point A, as in the first embodiment, is always affixed to the support bow 60 in each variation to insure movement in only one direction thereby preventing buckling from occurring. However, with respect to the remaining three points of contact B, C, and D (bows 60 to collar 700), any two of the three can be affixed to collars which can slide along the shaft 20 with the third remaining point being fixed. Hence, as shown in FIG. 8, point B can be fixed with points C and D sliding along shaft 20. In a second variation, points B and C can be connected to slideable collars with point D affixed, and finally in a third version, points B and D can be connected to sliding collars with point C being affixed. All three variations of affixing one point and providing relative movement along the shaft for the remaining two points will result in the same effect of providing only one dimensional movement 600 to the petal.

In the preferred embodiment, the shaft 20 is made from conventional full shaft material such as stainless steel; the support ribs and ridges are made from spring steel; the collars are made from stainless steel; and the petals are made from stainless shim stock.

In FIG. 9, the details of the releasing collar 30 are set forth to include a housing 900 having contained therein a coil spring 910 abutting against a stop 920 formed on the outer surface of the shaft 20. In the locked position, the housing 900 has a protruding end 930 which extends over the upper ends 74 of the petals 70. The housing member 900 abuts against a plunger 940 activated by a relay 950. Relay 950 is attached to the interior of shaft 20 and receives signals over leads 952. In operation, when the petals are collapsed about the shaft the coil spring 910 is compressed as shown in FIG. 9 and the plunger 940 is held in an activated position to hold the petals in the collapsed state. The basket 10 of the present invention is lowered into the bore hole and when at the desired location, the relay 950 is activated to release the plunger 940 in a direction of arrow 942 causing the coil spring 910 to push collar 30 in the direction of arrow 40 thereby selectively releasing the ends 74 of the petals 70 so that the petals open outwardly. It is to be understood that other mechanisms could be employed to release the petals under the teachings of the present invention.

Figure 10:
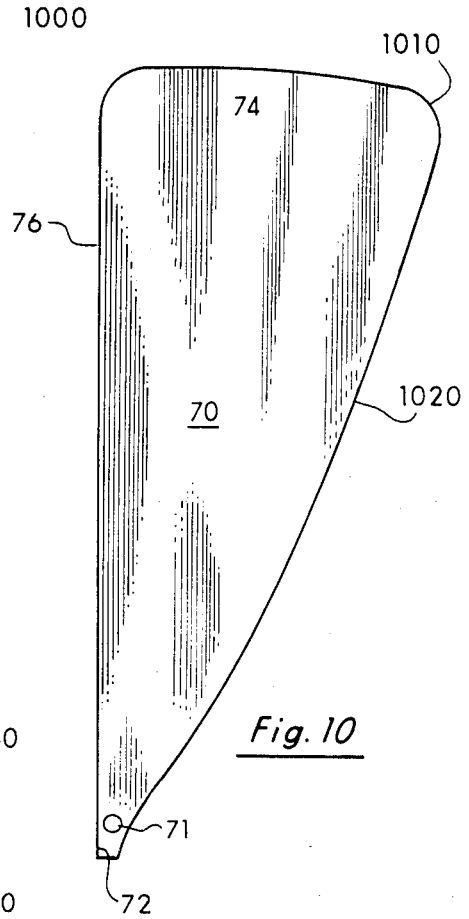
FIG. 10 is a perspective view of a single petal of the basket of the present invention.

In FIG. 10, the details of an individual petal 70 are shown having end 74, edge 76, and connecting point 71 on end 72. As can be observed, each petal is substantially triangular in shape with edge 76 being linear and terminating through a curve portion 1000 in petal end 74. End 74 undergoes a slight arc and terminates through a curved portion 1010 in edge 1020 which is also slightly arced. Edge 1020 terminates at end 72. As shown in FIG. 2, the petals are arranged around the shaft 20 so that the enlarged petal ends 74 are aligned and each petal overlaps with the next adjacent petal. This arrangement allows the petals to open and close as shown in FIGS. 1 and 2.

While the present invention has set forth two embodiments for a flow basket, it is expressly understood that changes and modifications can be made thereto which changes and modifications would fall within the scope and coverage of the following claims.

I claim:

1. A flow basket (10) connected to a shaft (20) for use in a bore hole to measure flow rates, said flow basket (10) comprising:

a plurality of petals (70), each of said petals being substantially triangular in shape and having one linear edge (76) located between an enlarged petal end (74) and a narrow terminal end (72), said plurality of petals (70) being arranged around said shaft (20) so that said petals overlap each other in order for said petals to open and close about said shaft, first means (78) connected to said terminal end (72) of said petals (70) for engaging said shaft (20) at a first predetermined location (B) on said shaft (20), a plurality of support ridges (80) with each support ridge (80) attached to one of said petals (70) along said linear edge (76), each said support ridge (80) being an elongated rectangle in shape and extending from a region near said terminal end (72) to a region near said petal end (74) of each said petal (70), a plurality of support bows (60) with each support bow (60) attached at one end (64) to said petal end (74) of said petal at a predetermined location (A) next to said attached support ridge (80), said support bow (60) extending over said first predetermined location (B) on said shaft (20) and having its opposing end (62) engaging said shaft (20) at a second predetermined location (C) on said shaft (20), and second means (50) connected to the opposing end (62) of said support bow (60) for engaging said shaft (20) at said second predetermined location, said first (78) and second engaging means (50) being capable of relative movement with respect to each other along said shaft (20) as said petals (70) open and close so that each said petal (70) is opened in an outward radial direction (600) only.

2. The flow basket (10) of claim 1, further comprising means (30) connected to said shaft (20) for slideably engaging said petal ends (74) of said plurality of petals (70) when said petals (70) are collapsed about said shaft (20) for selectively releasing said ends (74) so that said petals open outwardly.

3. The flow basket (10) of claim 1 wherein said first engaging means (78) is affixed to said shaft and wherein said second engaging means (50) slideably moves along said shaft (20).

4. The flow basket (10) of claim 1 wherein said second engaging means (50) is affixed to said shaft (20) and wherein said first engaging means (78) slideably moves along said shaft (20).

5. A flow basket (10) connected to a shaft (20) for use in a bore hole to measure flow rates, said flow basket (10) comprising:

a plurality of petals (70), each of said petals being substantially triangular in shape and having an enlarged petal end (74) and a narrow terminal end (72), said plurality of petals (70) being arranged around said shaft (20) so that said petals overlap each other in order for said petals to open and close about said shaft, first means (78) connected to said terminal end (72) of said petals (70) for engaging said shaft (20) at a first predetermined location (B) on said shaft (20), a plurality of support bows (60) attached at one end (64) to said petal end (74) of said petal at a predetermined location (A), said support bow (60) extending over said first predetermined location (B) on said shaft (20) and having its opposing end (62) engaging said shaft (20) at a second predetermined location (C) on said shaft (20), second means (50) connected to the opposing end (62) of said support bow (60) for engaging said shaft (20) at said second predetermined location, said first (78) and second means (50) being capable of relative movement with respect to each other along said shaft (20) at said petals (70) open and close so that each said petal (70) is opened in an outward radial direction (600) only, and means (30) connected to said shaft (20) for slideably engaging said petal ends (74) of said plurality of petals (70) when said petals (70) are collapsed about said shaft (20) for selectively releasing said ends (74) so that said petals open outwardly.

6. The flow basket (10) of claim 5 wherein said first engaging means (78) is affixed to said shaft and wherein said second engaging means (50) slideably moves along said shaft (20).

7. The flow basket (10) of claim 5 wherein said second engaging means (50) is affixed to said shaft (20) and wherein said first engaging means (78) slideably moves along said shaft (20).

8. A flow basket (10) connected to a shaft (20) for use in a bore hole to measure flow rates, said flow basket (10) comprising:

a plurality of petals (70), each of said petals having an enlarged petal end (74) and a narrow terminal end (72), said plurality of petals (70) being arranged around said shaft (20) so that said petals overlap each other in order for said petals to open and close about said shaft, first means (78) connected to said terminal ends (72) of said petals (70) for engaging said shaft (20) at a first predetermined location (B) on said shaft (20), a plurality of support bows (60) attached at one end (64) to said petal end (74) of said petal at a predetermined location (A), said support bow (60) extending over said first predetermined location (B) on said shaft (20) and having its opposing end (62) engaging said shaft (20) at a second predetermined location (C) on said shaft (20), and second means (50) connected to the opposing end (62) of said support bow (60) for engaging said shaft (20) at said second predetermined location, said first (78) and second means (50) being capable of relative movement with respect to each other along said shaft (20) as said petals (70) open and close so that each said petal (70) is opened in an outward radial direction (600) only.

9. A flow basket (10) connected to a shaft (20) for use in a bore hole to measure flow rates, said flow basket (10) comprising:

a plurality of petals (70), each of said petals having an enlarged petal end (74) and a narrow terminal end (72), said plurality of petals (70) being arranged around said shaft (20) and connected thereto at said narrow terminal end (72) by a first means (78) so that said petals overlap each other in order for said petals to open and close about said shaft, and a plurality of support bows (60) attached at one end (64) to said enlarged petal end (74) of said petal at a predetermined location (A), said support bow (60) having its opposing end (62) engaging said shaft (20) at a second predetermined location (C) on said shaft (20), and second means (50) connected to the opposing end (62) of said support bow (60) for engaging said shaft (20) at said second predetermined location, said first (78) and second means (50) being capable of relative movement with respect to each other along said shaft (20) as said petals (70) open and close so that each said petal (70) is opened in an outward radial direction (600) only.

10. A flow basket (10) connected to a shaft (20) for use in a bore hole to measure flow rates, said flow basket (10) comprising:

a plurality of petals (70), each of said petals being substantially triangular in shape and having one linear edge (76) located between an enlarged petal end (74) and a narrow terminal end (72), said plurality of petals (70) being arranged around said shaft (20) so that said petals overlap each other in order for said petals to open and close about said shaft, first means (78) connected to said terminal end (72) of said petals (70) for engaging said shaft (20) at a first predetermined location (B) on said shaft (20), a plurality of support ridges (80) with each support ridge (8) attached to one of said petals (70) along said linear edge (76), each said support ridge (80) being an elongated rectangle in shape and extending from a region near said terminal end (72) to a region near said petal end (74) of each said petal (70), a plurality of support bows (60) with each support bow centrally attached to said petal end (74) of said petal at a predetermined location (A) next to said attached support ridge (80), said support bow (60) extending over said first predetermined location (B) on said shaft (20); having one end (62) engaging said shaft (20) at a second predetermined location (C) on said shaft (20); and having its opposing end (602) engaging said shaft (20) at a third predetermined location (D), second means (50) connected to said end (62) of said support bow (60) for engaging said shaft (20) at said second predetermined location, and third means (700) connected to said opposing end (602) of said support bow for engaging said shaft (20) at said third predetermined location (D), said first (78), second (50), and third (700) engaging means being capable of relative movement with respect to each other along said shaft (20) provided one of said first (78), second (50), and third (700) engaging means is firmly affixed to said shaft (20) so that each petal is opened in an outward radial direction (600) only.

11. The flow basket (10) of claim 10 further comprising means (30) connected to said shaft (20) and slideably engaging said petal ends (74) of said plurality of petals (70) when said petals (70) are collapsed about said shaft (20) for selectively releasing said ends (74) so that said petals open outwardly.

12. The flow basket (10) of claim 10 wherein said first engaging means (78) is affixed to said shaft and wherein said second and third engaging means (50, 700) slideably moves along said shaft (20).

13. The flow basket (10) of claim 10 wherein said second engaging means (50) is affixed to said shaft (20) and wherein said first and third engaging means (78, 700) slideably moves along said shaft (20).

14. The flow basket (10) of claim 10 wherein said third engaging means (700) is affixed to said shaft (20) and wherein said first (78) and second (50) engaging means slideably moves along said shaft.

15. A flow basket (10) connected to a shaft (20) for use in a bore hole to measure flow rates, said flow basket (10) comprising:

a plurality of petals (70), each of said petals being substantially triangular in shape and having an enlarged petal end (74) and a narrow terminal end (72), said plurality of petals (70) being arranged around said shaft (20) so that said petals overlap each other in order for said petals to open and close about said shaft, first means (78) connected to said terminal end (72) of said petals (70) for engaging said shaft (20) at a first predetermined location (B) on said shaft (20), a plurality of support bows (60) with each support bow centrally attached to said petal end (74) of said petal at a predetermined location (A) said support bow (60) extending over said first predetermined location (B) on said shaft (20); having one end (62) engaging said shaft (20) at a second predetermined location (C) on said shaft (20); and having its opposing end (602) engaging said shaft (20) at a third predetermined location (D), second means (50) connected to said end (62) of said support bow (60) for engaging said shaft (20) at said second predetermined location, and third means (700) connected to said opposing end (602) of said support bow for engaging said shaft (20) at said third predetermined location (D), said first (78), second (50), and third (700) engaging means being capable of relative movement with respect to each other along said shaft (20) provided one of said first (78), second (50), and third (700) engaging means is firmly affixed to said shaft (20) so that each petal is opened in an outward radial direction (600) only.

16. The flow basket (10) of claim 15 further comprising means (30) connected to said shaft (20) and slideably engaging said petal ends (74) of said plurality of petals (70) when said petals (70) are collapsed about said shaft (20) for selectively releasing said ends (74) so that said petals open outwardly.

* * * * *